United States Patent [19]

Herrmann

[11] 4,162,217

[45] Jul. 24, 1979

[54] METHOD FOR SEPARATING IMPURITIES FROM A CHEMICAL METALLIZING BATH

[75] Inventor: Günther Herrmann, Nurnberg, Fed. Rep. of Germany

[73] Assignee: Grundig E.M.V. Elektro-Mechanische Versuschsanstalt, Fuerth, Fed. Rep. of Germany

[21] Appl. No.: 886,671

[22] Filed: Mar. 15, 1978

[30] Foreign Application Priority Data

Jul. 21, 1977 [DE] Fed. Rep. of Germany ..... 2732927

[51] Int. Cl.[2] ..... B01D 45/12

[52] U.S. Cl. ..... 210/84; 204/141.5; 210/243; 427/345

[58] Field of Search ..... 210/66, 78, 243, 84; 204/44, 52 R, 141.5, 145 R, 146, 106, 149; 427/345, 352

[56] References Cited

U.S. PATENT DOCUMENTS

| | | | |
|---|---|---|---|
| 2,025,768 | 12/1935 | Nieman | 427/345 X |
| 2,975,120 | 3/1961 | Kenmore et al. | 204/52 R X |
| 3,196,095 | 7/1965 | Wadsworth | 204/149 X |
| 3,957,452 | 5/1976 | Schaer et al. | 204/52 R X |
| 3,972,800 | 8/1976 | King | 204/149 X |

*Primary Examiner*—William A. Cuchlinski, Jr.
*Attorney, Agent, or Firm*—Kane, Dalsimer, Kane, Sullivan and Kurucz

[57] ABSTRACT

A bath solution is fed to a centrifuge wherein the impurities are precipitated onto the drum wall, due to centrifugal force and in the absence of electrical current, from which they are subsequently removed.

3 Claims, 1 Drawing Figure

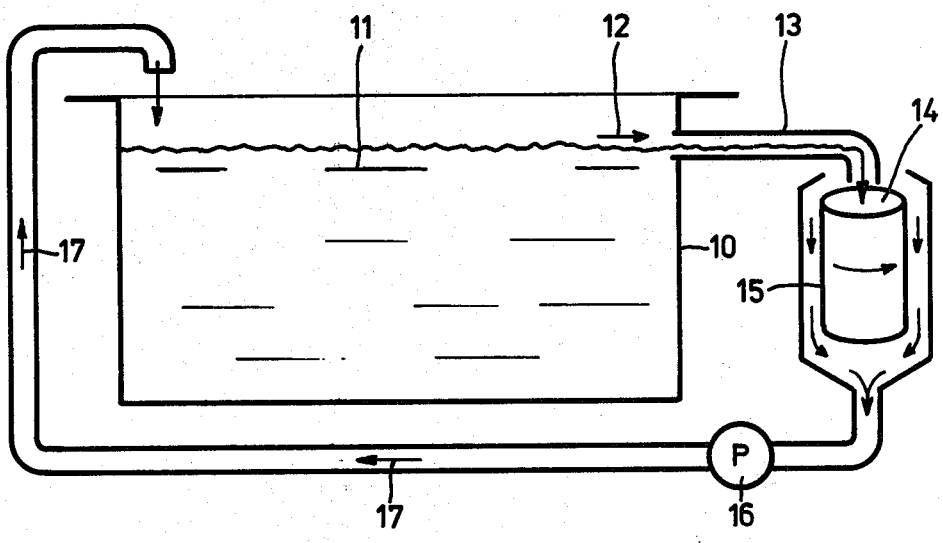
11
12
13
14
17
10
15
P
17
16

METHOD FOR SEPARATING IMPURITIES FROM A CHEMICAL METALLIZING BATH

BACKGROUND OF THE INVENTION

A substantial quantity of impurities are generated in chemical metallizing baths. The presence of these impurities, due to their effect as seen crystals, result in substantial precipitations at the bottom of the chemical bath (bottom metallizing). These crystals cause an increase consumption of chemicals. This results in a steady increase of superfluous bath solution, the removal of which presents environmental problems.

SUMMARY OF THE INVENTION

This invention provides a simple and inexpensive method by which the impurities of the chemical metallizing bath may be separated in the absence of electrical current in the bath for this purpose and whereby precipitation at the bottom of the bath is substantially prevented. This is accomplished by feeding the bath solution to a centrifuge wherein the centrifugal force precipitates the impurities onto the drum wall, from which they may be subsequently removed. The invention provides for the removal of the precipitation from the drum wall either continuously or discontinuously.

The invention further contemplates the connection of the drum wall of the centrifuge as an anode allowing for ready return of separated metal into the solution. This is particularly advantageous in copper plating. The non-metallic impurities can then be allowed to remain in the drum.

BRIEF DESCRIPTION OF THE DRAWING

In the FIGURE there is diagrammatically shown as an example structure useful in practicing the method of separating impurities from a chemical metallizing bath, in the absence of electrical current in the bath for that purpose, in accordance with my invention.

DESCRIPTION OF A PREFERRED EMBODIMENT

In the FIGURE solution 11 is shown contained in container 10. Solution 11 may be, for example, a copper plating bath. Bath 11 is fed in the direction of arrow 12 through an overflow conduit 13 and into centrifuge 14 the rotation of which is shown in the FIGURE as being about a vertical axis. Due to the centrifugal force resulting from rotation of solution 11 in the centrifuge 14 impurities of both a metallic and non-metallic nature collect on drum wall 15. It is desirable to return the metallic impurities which have been removed in this manner to chemical solution 11 with suitable means. Feed pump 16 is provided to so return the purified solution to container 10 by movement of this purified solution through a conduit in the direction of the arrows 17. This purification of the chemical bath effectively prevents bottom metallizing and precipitation of other foreign matter in container 10. Drum wall 15 of the centrifuge is connected as an anode so that the separated metal, for example, copper can be returned to the container immediately and continuously. The residual solids which remain at the drum wall 15 consist of residual impurities of non-metallic chemicals. Due to the provision of drum wall 15 as an anode whereby dissolving the copper is accomplished instead of the hitherto return of the metal in its salt shape, for example, sulfate, the formation of alkali salts is greatly diminished, because of the reduced addition of aniones. Since these salts heretofore were responsible for an increase in the density of the bath, with the practice of this invention it is not necessary to dilute with water in order to maintain the bath density at its normal value. Thus the bath overflow is substantially reduced as well as the achieving of a substantial reduction in the consumption of chemicals.

In addition to the improved economy of operation, the problems of removal of the superfluous bath solution are reduced, since lesser quantities are used. As a result the problems of maintaining a clean environment are also reduced.

I claim:

1. A method for separating impurities from a metallizing bath, in the absence of electrical current in the bath including the steps of feeding the bath solution to a centrifuge, removing the impurities by precipitating onto the drum wall by centrifugal force, and subsequently removing the metallic impurities from the centrifuge wall by activation of the centrifuge wall as in anode.

2. A method according to claim 1 wherein the metallic impurities are continuously removed from the drum wall of the centrifuge.

3. A method according to claim 1 wherein the metallic impurities are discontinuously removed from the drum wall of the centrifuge.

* * * * *